US006151997A

United States Patent [19]

Lin

[11] Patent Number: 6,151,997

[45] Date of Patent: Nov. 28, 2000

[54] TOOL HAVING IMPROVED DRIVING TORQUE

[76] Inventor: Ching Chou Lin, No. 150, Sec. 3, Chung San Road, Wu Zh Hsiang, Taichung Hsien, Taiwan

[21] Appl. No.: 09/262,292

[22] Filed: Mar. 4, 1999

[51] Int. Cl.[7] ..... B25B 23/16

[52] U.S. Cl. ..... 81/177.4; 81/489; 7/127; 7/165

[58] Field of Search ..... 81/177.4, 177.5, 81/489, 490; 7/127, 165

[56] References Cited

U.S. PATENT DOCUMENTS 5,069,091 12/1991 Bramsiepe et al. ..... 81/177.7
5,421,225 6/1995 Chen ..... 81/490
5,515,249 5/1996 Shiao ..... 362/119
5,735,005 4/1998 Wang ..... 7/127

*Primary Examiner*—James G. Smith
*Assistant Examiner*—Hadi Shakeri
*Attorney, Agent, or Firm*—Charles E. Baxley

[57] ABSTRACT

A tool includes a handle having a shank extended from one end for engaging with and for driving fasteners. A driving stem has an extension for engaging into the orifice of the shank and has an engaging hole for receiving and driving the fasteners. The shank and the driving stem are extended from one end of the handle such that the handle may apply a greater torque against the driving stem. A cover is pivotally coupled to the handle and has one or more wheel members for forming a roller skate shape. The shank has a clamping device for clamping the driving stem in place.

5 Claims, 4 Drawing Sheets

TOOL HAVING IMPROVED DRIVING TORQUE

BACKGROUND OF THE INVENTION

1. Field of the Invention

The present invention relates to a tool, and more particularly to a tool having an improved driving torque.

2. Description of the Prior Art

Typical tools, particularly the screw driver comprise a T-shaped handle and a driving stem attached to the handle. The driving stem is secured to the middle portion of the handle such that the driving torque of the handle to the driving stem is limited.

The present invention has arisen to mitigate and/or obviate the afore-described disadvantages of the conventional tools.

SUMMARY OF THE INVENTION

The primary objective of the present invention is to provide a tool having an improved driving torque for facilitating the driving operation of the tool.

The other objective of the present invention is to provide a tool having an in-line skate configuration for decoration purposes.

The further objective of the present invention is to provide a tool having an improved clamping device for the driving stem.

In accordance with one aspect of the invention, there is provided a tool comprising a handle including a first end having a shank extended therefrom, the shank including a first end integral with the handle and including a second end having an orifice formed therein for receiving and driving fasteners, and a driving stem including a first end having an extension extended therefrom for engaging into the orifice of the shank and including a second end having an engaging hole formed therein for receiving and driving the fasteners. The shank and the driving stem are extended from the first end of the handle for allowing the handle to apply a greater torque against the driving stem.

The handle includes a plurality of chambers formed therein for receiving the fasteners, and a cover having a first end pivotally coupled to the first end of the handle and having a second end, and means for securing the cover to the handle for enclosing and for retaining the fasteners in the handle.

The first end of the handle includes an opening formed therein, the cover includes a projection extended from the first end of the cover and engaged into the opening of the handle and pivotally coupled to the first end of the handle at a pivot shaft. The cover includes at least one convex protrusion extended therefrom.

The shank includes a clamping device having a pair of arms and having a pair of protrusions extended from the arms respectively and extended toward each other for extending inward of the orifice of the shank to engage with the driving stem. The shank includes an outer peripheral portion having an annular shoulder formed therein for separating the shank into a first portion and a second portion of a greater size than that of the first portion, the arms are moved away from each other when the arms are rotated about the protrusions of the arms and engaged with the second portion of the shank.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
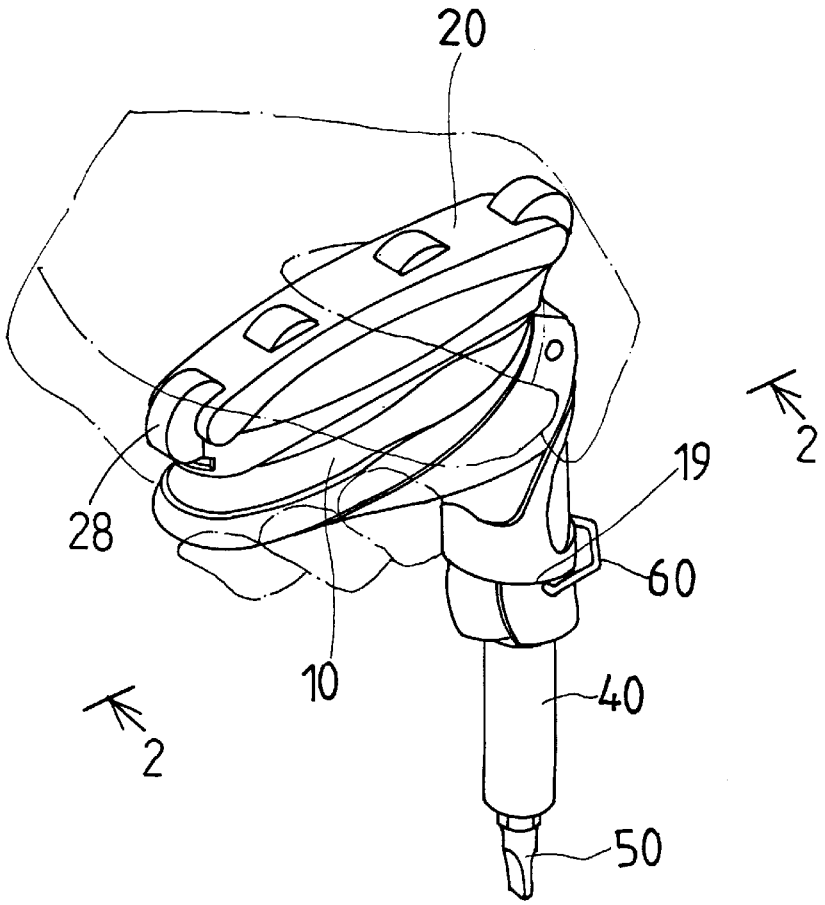
FIG. 1 is an upper perspective view of a tool in accordance with the present invention.
Figure 2:
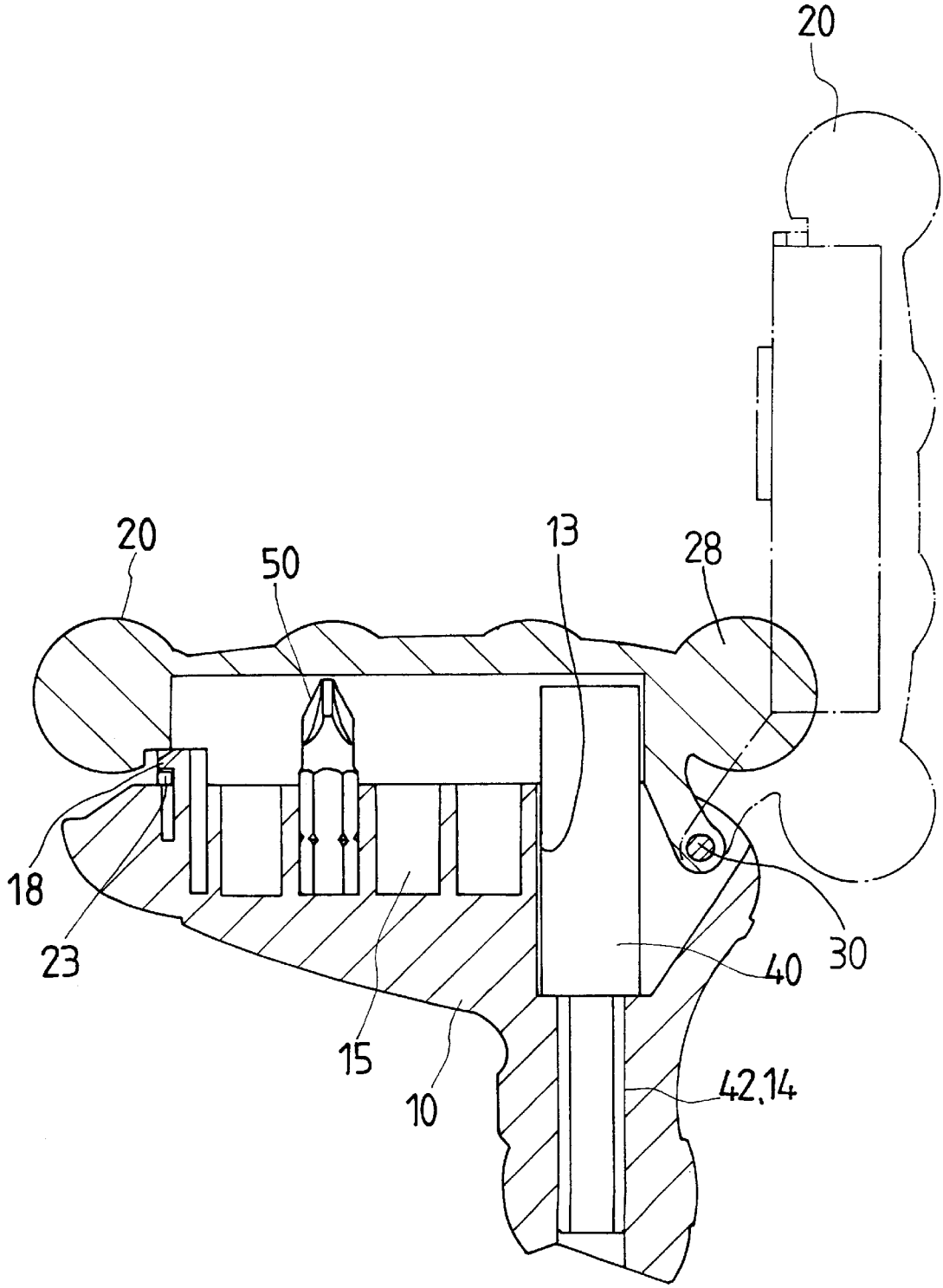
FIG. 2 is a cross sectional view taken along lines 2—2 of FIG. 1.
Figure 3:
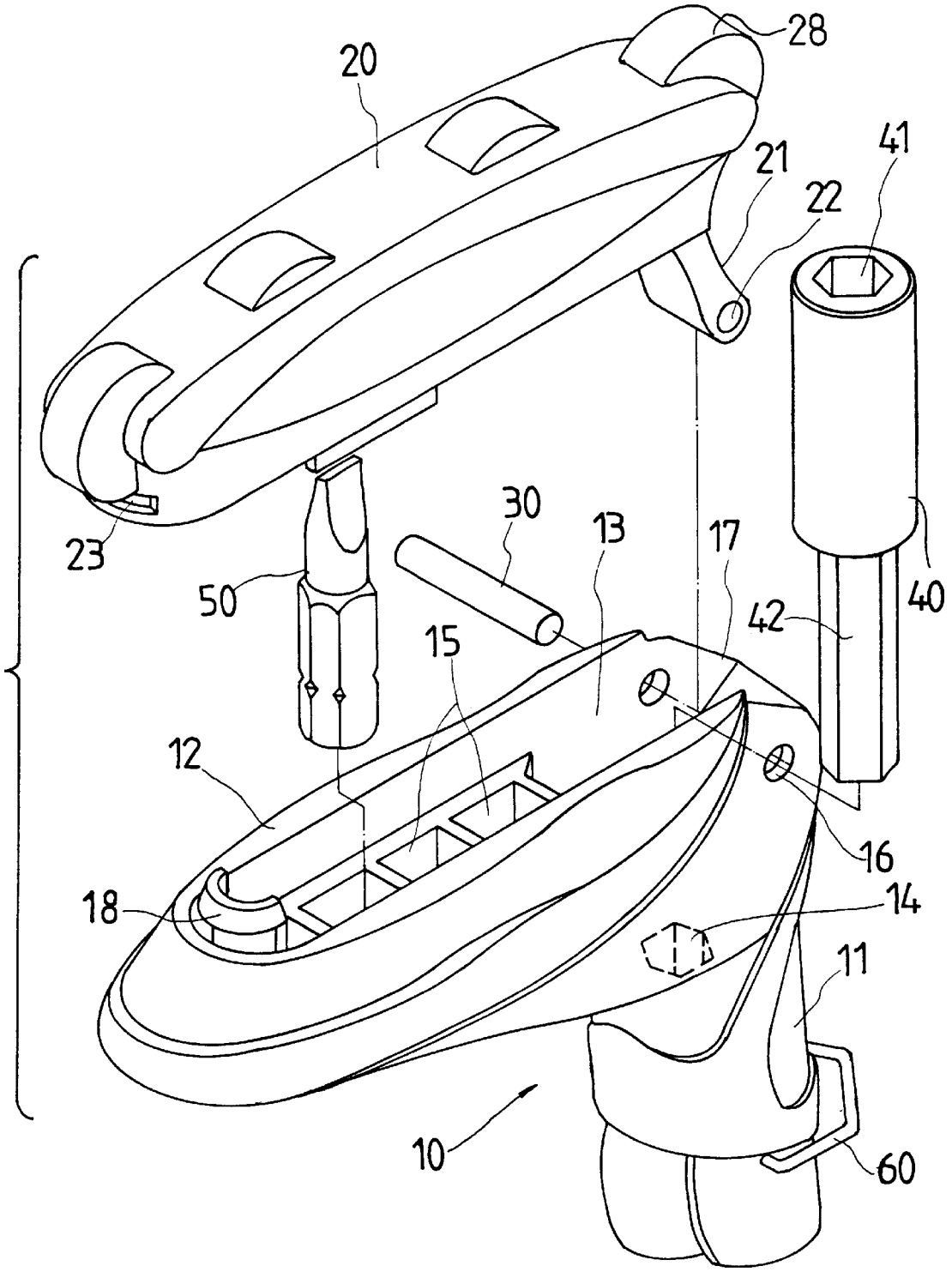
FIG. 3 is an exploded view of the tool.

Referring to the drawings, and initially to FIGS. 1–3, a tool in accordance with the present invention comprises a body 10 including a shank 11 and a handle 12 integrally formed or secured together at one end thereof for forming an L-shape structure, but not necessarily be perpendicular with each other. The shank 11 includes a bore 13 formed therein and an orifice 14 of non-circular cross section or of hexagonal cross section formed therein for receiving an extension 42 of a driving stem 40 and for storing the driving stem 40. The driving stem 40 includes an engaging hole 41 formed therein for receiving the tool bits 50 or the fasteners. The driving stem 40 may be removed from the bore 13 of the body 10 and the extension 42 of the driving stem 40 may engage in the orifice 14 of the shank 11 such that the driving stem 40 may be rotated by the body 10. The shank 11 and the driving stem 40 are extended from one end of the handle 12 such that the handle 12 may apply a greater torque onto the driving stem 40.

Figure 4:
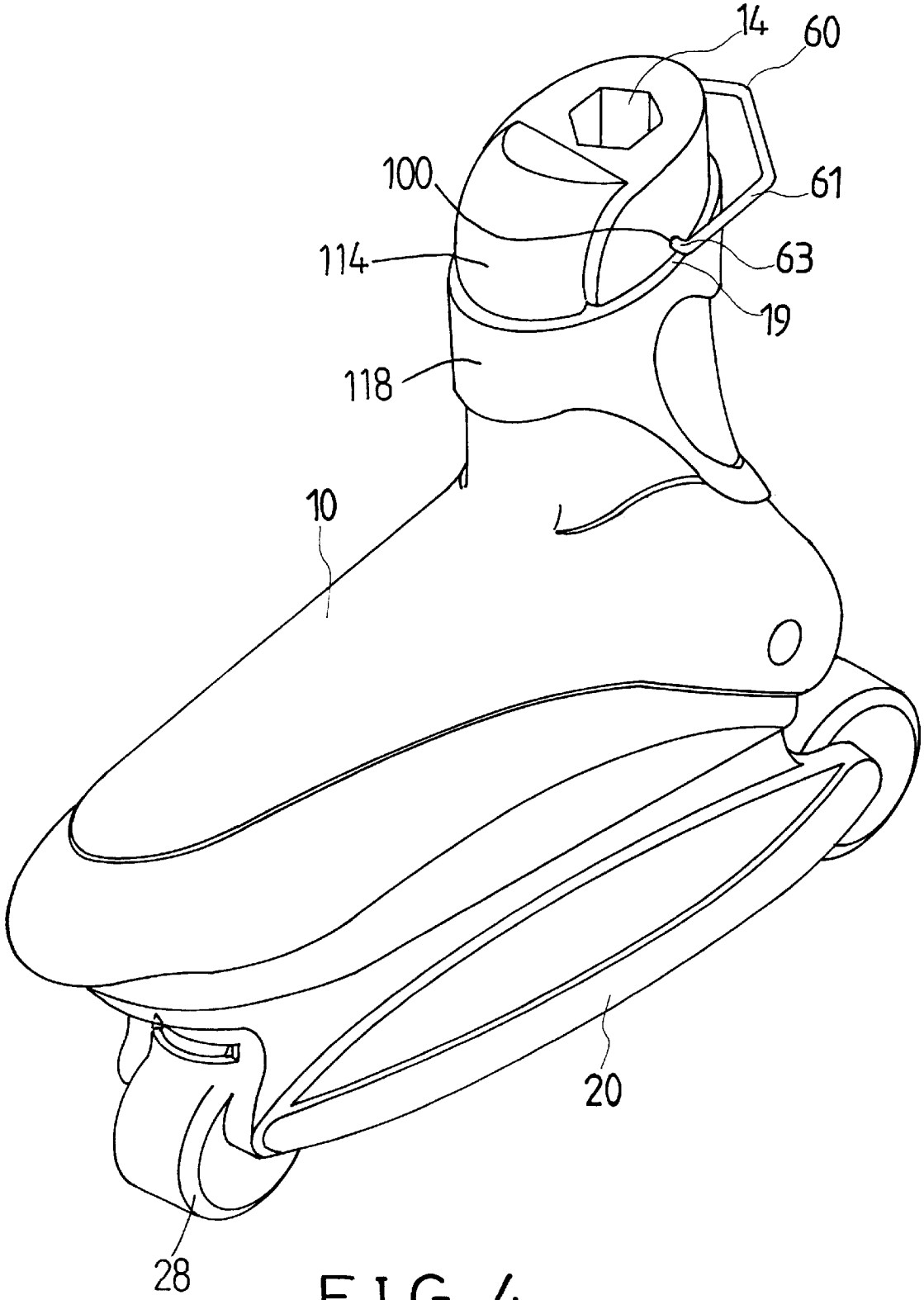
FIG. 4 is a bottom perspective view illustrating the application of the tool.

The handle 12 includes a number of chambers 15 formed therein for receiving the tool bits 50 or the other tools or the fasteners, and includes a latch 18 provided on one end opposite to the shank 11. A cover 20 includes a projection 21 extended from one end and having a hole 22 formed therein for receiving a shaft 30 which is engaged through the holes 16 of the handle 12 for pivotally coupling the cover 20 to the handle 12. The projection 21 is rotatably received in an opening 17 of the handle 12 that communicates with the bore 13 of the shank 11. The cover 20 includes a notch 23 formed in the other end opposite to the projection 21 thereof for receiving the latch 18 and for securing the cover 20 to the handle 12 and for retaining the tool bits 50 and the driving stem 40 in the handle 12 (FIG. 2). The cover 20 includes one or more convex protrusions 28 extended therefrom for forming a shape of an in-line skate (FIG. 4) and for forming an excellent decorating configuration and for supporting the tool at an upright or standing position. in addition, the convex protrusions 28 may also be used for facilitating the grasping and driving operation to the tool.

Figure 5:
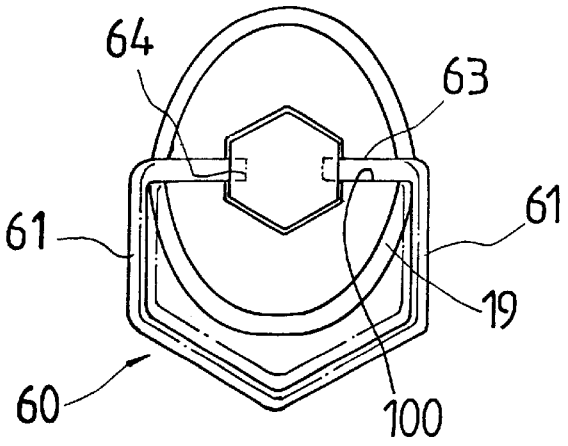
FIG. 5 is a partial plane view of the tool.

Referring next to FIG. 5, and again to FIG. 1, the shank 11 includes a peripheral shoulder 19 formed in the outer peripheral port ion thereof for forming a first portion 114 of smaller size than the other portion 118, and includes an aperture 100 laterally formed therein and intersecting or communicating with the orifice 14 of the shank 11. A clamping device 60 preferably includes a pentagon shape having a pair of arms 61 and a protrusion 63 extended toward each other from the free end of the arms 61. The protrusions 63 of the clamping device 60 each includes a tip 64 extended inward of the orifice 14 of the shank 11 (FIG. 5) for engaging with and for retaining the driving stem 40 or the fasteners in place. As shown in dotted lines in FIG. 5, the clamping device 60 includes a suitable resilience for biasing the protrusions 63 inward of the shank 11 to engage with the driving stem 40. However, when the clamping device 60 is depressed and rotated about the protrusions 63 thereof and to engage with the other portion 118 of a greater size than that of the first portion 114, the arms 61 of the clamping device 60 will be moved away from each other for releasing the driving stem 40. The protrusions 63 of the clamping device 60 will be biased inward of the shank 11 again when the clamping device 60 is released.

Alternatively, the cover 20 and the handle 12 may be formed as an integral member having the in-line roller skate shape.

Accordingly, the tool in accordance with the present invention includes an improved driving torque for facilitating the driving operation of the tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a first end having a shank extended therefrom. said shank including a first end integral with said handle and including a second end having an orifice formed therein for receiving and driving fasteners, said handle including a plurality of chambers formed therein for receiving the fasteners, said first end of said handle including an opening formed therein, a driving stem including a first end having an extension extended therefrom for engaging into said orifice of said shank and including a second end having an engaging hole formed therein for receiving and driving the fasteners, a cover having a first end pivotally coupled to said first end of said handle and-having a second end, said cover including a projection extended from said first end of said cover and engaged into said opening of said handle and pivotally coupled to said first end of said handle at a pivot shaft, and means for securing said cover to said handle for enclosing and for retaining the fasteners in said handle, said shank and said driving stem being extended from said first end of said handle for al lowing said handle to apply a greater torque against said driving stem.

2. The tool according to claim 1, wherein said cover includes at least one convex protrusion extended therefrom.

3. The tool according to claim 1, wherein said shank includes means for retaining said driving stem in said shank.

4. A tool comprising:

a handle including a first end having a shank extended therefrom, said shank including a first end integral with said handle and including a second end having an orifice formed therein for receiving and driving fasteners, a driving stem including a first end having an extension extended therefrom for engaging into said orifice of said shank and including a second end having an engaging hole formed therein for receiving and driving the fasteners, said shank and said driving stem being extended from said first end of said handle for a allowing said handle to apply a greater torque against said riving stem, and means for retaining said driving stem in said shank, wherein said shank includes a clamping device having a pair of arms and having a pair of protrusions extended from said arms respectively and extended toward each other for extending inward of said orifice of said shank to engage with said driving stem.

5. The tool according to claim 4, wherein said shank includes an outer peripheral portion having an annular shoulder formed therein for separating said shank into a first portion and a second portion of a greater size than that of said first portion, said arms are moved away from each other when said arms are rotated about said protrusions of said arms and engaged with said second portion of said shank.

* * * * *